US006131623A

United States Patent [19]

Nusbaumer et al.

[11] Patent Number: 6,131,623

[45] Date of Patent: Oct. 17, 2000

[54] FUELING NOZZLE, VACUUM SENSING MEANS AND COMPONENTS THEREFOR AND METHODS OF MAKING THE SAME

[76] Inventors: Joseph M. Nusbaumer, 1602 Oak Ridge Ct., Nixa, Mo. 65714; Ronald Woods, 5186 N. Farm Rd. 159, Springfield, Mo. 65803

[21] Appl. No.: 09/362,820

[22] Filed: Jul. 28, 1999

[51] Int. Cl.[7] ..... B65B 1/04

[52] U.S. Cl. ..... 141/206; 141/392; 141/59

[58] Field of Search ..... 141/206–226, 141/59, 392

[56] References Cited

U.S. PATENT DOCUMENTS

| | | | |
|---|---|---|---|
| 3,016,928 | 1/1962 | Brandt | 141/45 |
| 3,085,600 | 4/1963 | Briede | 141/209 |
| 3,101,101 | 8/1963 | Gearhart et al. . | |
| 3,653,415 | 4/1972 | Boudot et al. | 141/208 |
| 5,755,256 | 5/1998 | Elsdon et al. | 141/206 |
| 6,026,866 | 2/2000 | Nanaji | 141/59 |

*Primary Examiner*—Steven O. Douglas
*Attorney, Agent, or Firm*—Richard L. Marsh

[57] ABSTRACT

An automated fueling nozzle for transferring fuel from a fuel storage tank to a vehicle fuel storage tank has a vacuum sensing arrangement disposed outboard of a discharge end of an outlet spout of the nozzle to interrupt the flow of fuel when the tank is substantially full to prevent reflux of fuel from the vehicle tank through the inlet conduit of the vehicle tank.

20 Claims, 6 Drawing Sheets

FUELING NOZZLE, VACUUM SENSING MEANS AND COMPONENTS THEREFOR AND METHODS OF MAKING THE SAME

BACKGROUND OF THE INVENTION

1. Field of the Invention

This invention relates to an automated fueling nozzle adapted for transferring fuel from a fuel storage tank to a vehicle fuel storage tank wherein the fueling nozzle has a release means for automatically releasing a main valve responsive to a vacuum sensing means disposed remote from an end of the fueling nozzle and wherein the fueling nozzle has adjusting means thereon for use in the fueling inlet conduit of fuel storage tanks having differing lengths of fueling inlet conduits.

2. Prior Art Statement

It is known to provide an automatic dispensing nozzle for transferring fuel from a fuel storage tank to a vehicle fuel storage tank wherein the fueling nozzle comprises a hollow body having an inlet port, an outlet spout at one end of the body, a main valve in the body for controlling flow of fuel from the inlet port to the spout, means for manually operating the main valve, a pressure actuated valve within the body adjacent the outlet spout, the pressure actuated valve having opposed surfaces between a tappet and a seat for providing a Venturi means for creating a vacuum and a release means for automatically releasing the main valve responsive to a vacuum sensing means controlling the vacuum. For instance, see the U.S. Pat. No. 3,085,600 issued on Apr. 16, 1963 to Arthur F. Briede or the U.S. Pat. No. 3,653,415 to Boudot, et al.

It is also known to provide a device for extracting fumes from liquid fuel containers through an air line disposed in the fuel supply line. For instance, see the U.S. Pat. No. 3,016,928 issued on Jan. 16, 1962 to Robert Jay Brandt.

SUMMARY OF THE INVENTION

Heretofore, the prior art nozzles have not been used for filling water borne vessel storage tanks having an extended inlet conduit associated with the storage tank of the vessel as the reflux of fuel into the inlet conduit to shut off the nozzle results in spillage from the open end of the inlet conduit or a detached vent stand pipe. Fishing vessels used for extended travel away from a port where petroleum based products used by the vessel are readily available commonly have multiple fuel, lubricating oil and crude fuel oil storage tanks spaced around the vessel hull accessible through an elongated fueling inlet conduit disposed through the deck plating. Rapid filling of each of these tanks is essential to an effective fishing operation, hence high filling rates from the onshore storage tanks is widely utilized. Each of the vessel storage tanks also has a separate venting stand pipe associated with the tank disposed through the deck plating and it is typical practice to place the filling nozzle or hose into the fueling inlet conduit, open the filling valve and determine a full condition of the tank by observing spillage from the venting stand pipe. Upon completion of the filling action, it is also common to spray wash the spillage overboard through a gunwale port. Such practice results in fuel, lubricating oil or crude fuel oil cascading downward from the gunwale ports along the sides of the vessel and into the port water. Fuel waste, environmental damage in the port and fishing habitat have been destroyed. Fuel waste and port damage are quite obvious but vessels carrying a portion of the spilled fuel oil clinging to the sides of the vessel to the fishing habitat where the action of the vessel in sea water results in removal of the fuel, lubricating oil or crude fuel has caused the loss of fisheries. Environmentalists are calling for solutions to the problem and fishers have recognized the need for cleaning up the fueling operation.

Therefore, it is an object of this invention to provide an automated fueling nozzle adapted for transferring fuel from a fuel storage tank to a vehicle fuel storage tank, the vehicle fuel tank having an inlet conduit associated therewith, the fueling nozzle comprising a hollow body having an inlet port, an outlet spout at one end of the body, a main valve in the body for controlling flow of fuel from the inlet port to the spout, means for manually operating the main valve, a pressure actuated valve within the body adjacent the outlet spout, the pressure actuated valve having opposed surfaces between a tappet and a seat for providing a Venturi means for creating a vacuum and a release means for automatically releasing the main valve responsive to a vacuum sensing means controlling the vacuum, the improvement wherein the vacuum sensing means is disposed outboard of a discharge end of the outlet spout.

It is also an object of this invention to provide an automated fueling nozzle having the vacuum sensing means disposed outboard of a discharge end of the outlet spout and disposed within the fuel stream being discharged from the discharge end of an outlet spout of the fueling nozzle.

Yet another object of this invention is to provide an automated fueling nozzle wherein the vacuum sensing means is disposed outboard of a discharge end of the outlet spout and disposed substantially contiguous with an uppermost fueling level of the vehicle storage tank.

Still another object of this invention is to provide an automated fueling nozzle wherein the vacuum sensing means is disposed outboard of a discharge end of the outlet spout and disposed at a distance from the discharge end of the outlet spout at least equal to the length of the inlet conduit of the fuel tank less the length of the outlet spout.

A further object of this invention is to provide an automated fueling nozzle wherein the vacuum sensing means is disposed outboard of a discharge end of the outlet spout at an open end of an elongated tube, the elongated tube depending from the hollow body wherein the elongated tube is independent of the outlet spout.

Still a further object of this invention is to provide an automated fueling nozzle wherein the end of the elongated tube depending from the hollow body of the fueling nozzle has means for directing the fuel stream away from the end of the elongated tube.

Yet a further object of this invention is to provide an automated fueling nozzle having an elongated tube depending from the hollow body of the fueling nozzle wherein means for directing the fuel stream comprises a cone shaped member affixed to the end of the elongated tube, the cone shaped member directing the fuel stream away from the vacuum sensing means.

Yet still a further object of this invention is to provide an automated fueling nozzle having an elongated tube depending from the hollow body of the fueling nozzle wherein means for directing the fuel stream comprises a cone shaped member affixed to the end of the elongated tube, the cone shaped member directing the fuel stream away from the vacuum sensing means, wherein the vacuum sensing means is recessed within an elongated member depending from the cone shaped member.

It is yet another object of this invention to provide an automated fueling nozzle having an elongated tube depending from the hollow body of the fueling nozzle wherein the elongated tube comprises a flexible tube.

Those skilled in the art will recognize that another object of this invention is to provide an automated fueling nozzle having an elongated tube depending from the hollow body of the fueling nozzle wherein the elongated tube comprises a flexible tube having the cone shaped member at the terminal end thereof disposes the vacuum sensing means substantially centrally within the fuel stream and wherein the cone shaped member has the smaller base thereof affixed contiguous with the end of the tube.

A notable object of this invention is to provide an automated fueling nozzle wherein the cone shaped member has the smaller base thereof affixed to the end of the tube and the larger open end of the cone shaped member disposed remote from the end of the tube.

A significant object of this invention is to provide an automated fueling nozzle adapted for transferring fuel from a fuel storage tank to a vehicle fuel storage tank, the vehicle fuel tank having an inlet conduit associated therewith, the fueling nozzle comprising a hollow body having an inlet port, an outlet spout at one end of the body, a main valve in the body for controlling flow of fuel from the inlet port to the spout, means for manually operating the main valve, a pressure actuated valve within the body adjacent the outlet sport, the pressure actuated valve having opposed surfaces between a tappet and a seat for providing a Venturi means for creating a vacuum and a release means for automatically releasing the main valve responsive to a vacuum sensing means controlling the vacuum wherein the outlet spout has means for adjusting the depth of penetration of the outlet spout into the inlet conduit of the vehicle tank.

Still another object of this invention is to provide an automated fueling nozzle having means associated with the outlet spout for adjusting the depth of penetration of the outlet spout into the inlet conduit of the vehicle tank wherein the means for adjusting comprises an annular adjusting ring disposed around the outlet spout.

Another feature of this invention is to provide an automated fueling nozzle having means associated with the outlet spout for adjusting the depth of penetration of the outlet spout into the inlet conduit of the vehicle tank wherein the outlet spout has a first end opposite the discharge end affixed to the hollow body, the means for adjusting having a first stop disposed adjacent the first end.

Still another feature of this invention is to provide an automated fueling nozzle having means associated with the outlet spout for adjusting the depth of penetration of the outlet spout into the inlet conduit of the vehicle tank wherein the means for adjusting further comprising a terminal stop spaced inwardly from the discharge end and/or substantially at the discharge end.

Yet another feature of this invention is to provide an automated fueling nozzle having means associated with the outlet spout for adjusting the depth of penetration of the outlet spout into the inlet conduit of the vehicle tank wherein the means for adjusting further comprises a first stop disposed adjacent the first end and/or an intermediate stop spaced inwardly from the discharge end.

Still another object of this invention is to provide an automated fueling nozzle having means associated with the outlet spout for adjusting the depth of penetration of the outlet spout into the inlet conduit of the vehicle tank wherein the means for adjusting comprises an annular adjusting ring disposed around the outlet spout and wherein the annular adjusting ring has means for releasably affixing the annular adjusting ring to the outlet spout.

Another object of this invention is to provide an automated fueling nozzle having means associated with the outlet spout for adjusting the depth of penetration of the outlet spout into the inlet conduit of the vehicle tank wherein the means for adjusting comprises an annular adjusting ring disposed around the outlet spout and wherein the annular adjusting ring has means for releasably affixing wherein the means for affixing comprises a thumb screw threaded through a wall of the annular adjusting ring.

Another object of this invention is to provide an automated fueling nozzle having means associated with the outlet spout for adjusting the depth of penetration of the outlet spout into the inlet conduit of the vehicle tank wherein the means for adjusting comprises an annular adjusting ring disposed around the outlet spout and wherein the annular adjusting ring has means for releasably affixing wherein the means for affixing comprises a locating pin threaded into a wall of the spout and a key slot in the annular adjusting ring, the pin adapted to slide through the shank portion of the key slot and be releasably retained in the key portion of the key slot.

Finally it is an significant object of this invention to provide an automated fueling nozzle adapted for transferring fuel from a fuel storage tank to a vehicle fuel storage tank, the vehicle fuel tank having an inlet conduit associated therewith, the fueling nozzle comprising a hollow body having an inlet port, an outlet spout at one end of the body, a main valve in the body for controlling flow of fuel from the inlet port to the spout, means for manually operating the main valve, a pressure actuated valve within the body adjacent the outlet sport, the pressure actuated valve having opposed surfaces between a tappet and a seat for providing a Venturi means for creating a vacuum and a release means for automatically releasing the main valve responsive to a vacuum sensing means controlling the vacuum, the improvement wherein the vacuum sensing means is disposed outboard of a discharge end of the outlet spout to prevent reflux of fuel from the vehicle tank through the conduit.

DESCRIPTION OF THE PREFERRED EMBODIMENTS

While the various features of this invention are hereinafter described and illustrated as a automated fueling nozzle adapted for transferring fuel from a fuel storage tank to a vehicle fuel storage tank wherein the fueling nozzle has a release means for automatically releasing a main valve responsive to a vacuum sensing means, it is to be understood that the various features of this invention can be used singly or in various combinations thereof to provide an automated fueling nozzle adapted for transferring fuel from a fuel storage tank to a vehicle fuel storage tank as can hereinafter be appreciated from a reading of the following description.

The prior art is replete with various vacuum sensing means associated with filling a storage tank from another storage tank wherein the vacuum sensing means is ported through the wall of a filling spout for sensing back flow between the inlet conduit and the outlet filling spout where the back flow comes through a vent tube connected to the inlet conduit. Such a filling spout and vacuum sensing means works well with low flow rates as the vacuum sensing means has ample time to react before an overfill condition exists thereby preventing spillage, however as recited above, in the fueling of ocean going fishing vessels, a high rate fueling operation often causes spillage of fuel through a vent pipe or from the open end of the inlet conduit. There is however, a great need to terminate a high rate filling operation before spillage occurs through the open end of the filling spout or the separate venting stand pipe.

Figure 1:
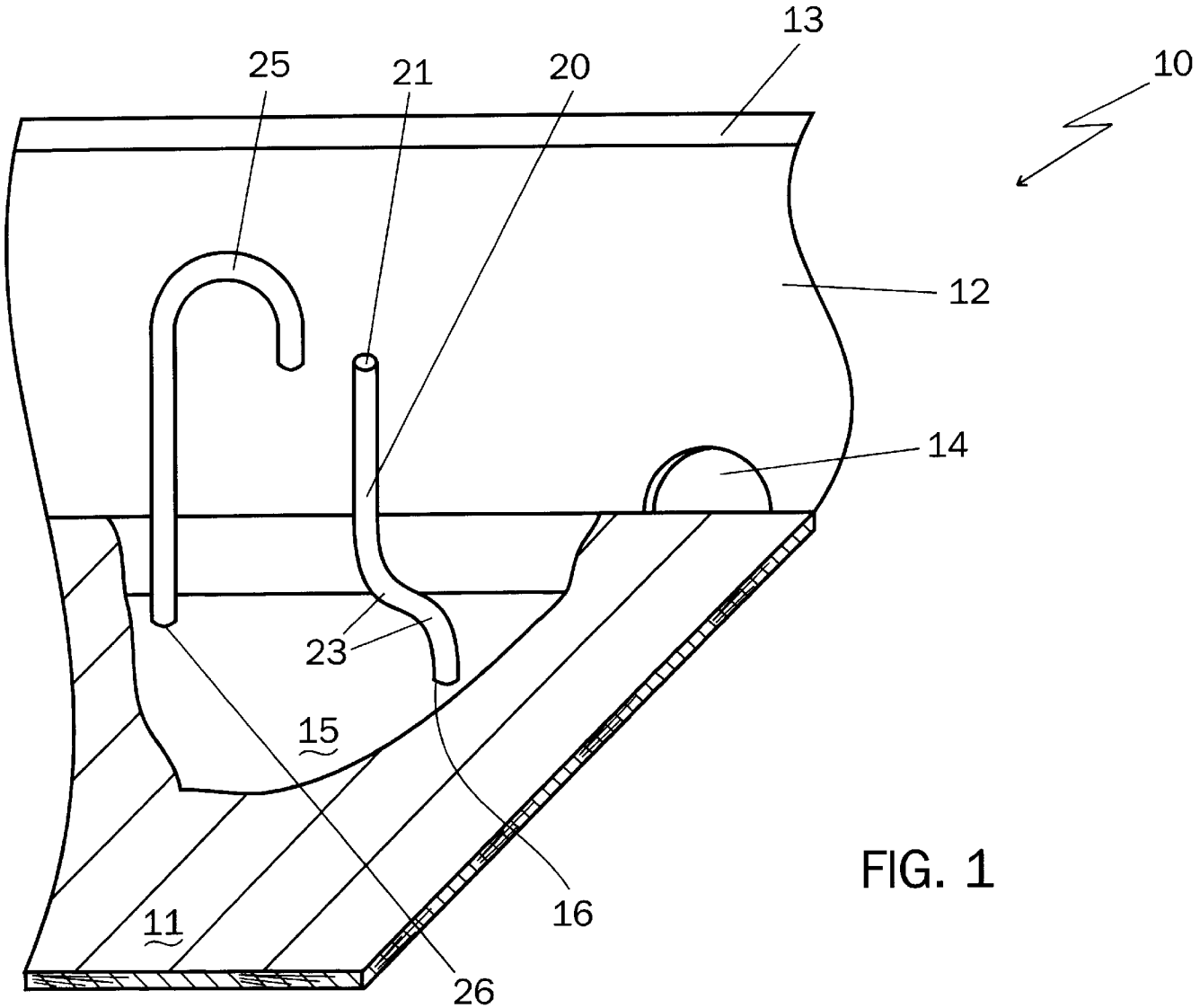
FIG. 1 is a partial perspective view of a fueling station on the deck of a marine vessel showing a typical arrangement of the fueling inlet conduit and tank vent stand pipe adjacent the gunwale of the marine vessel.
Figure 2:
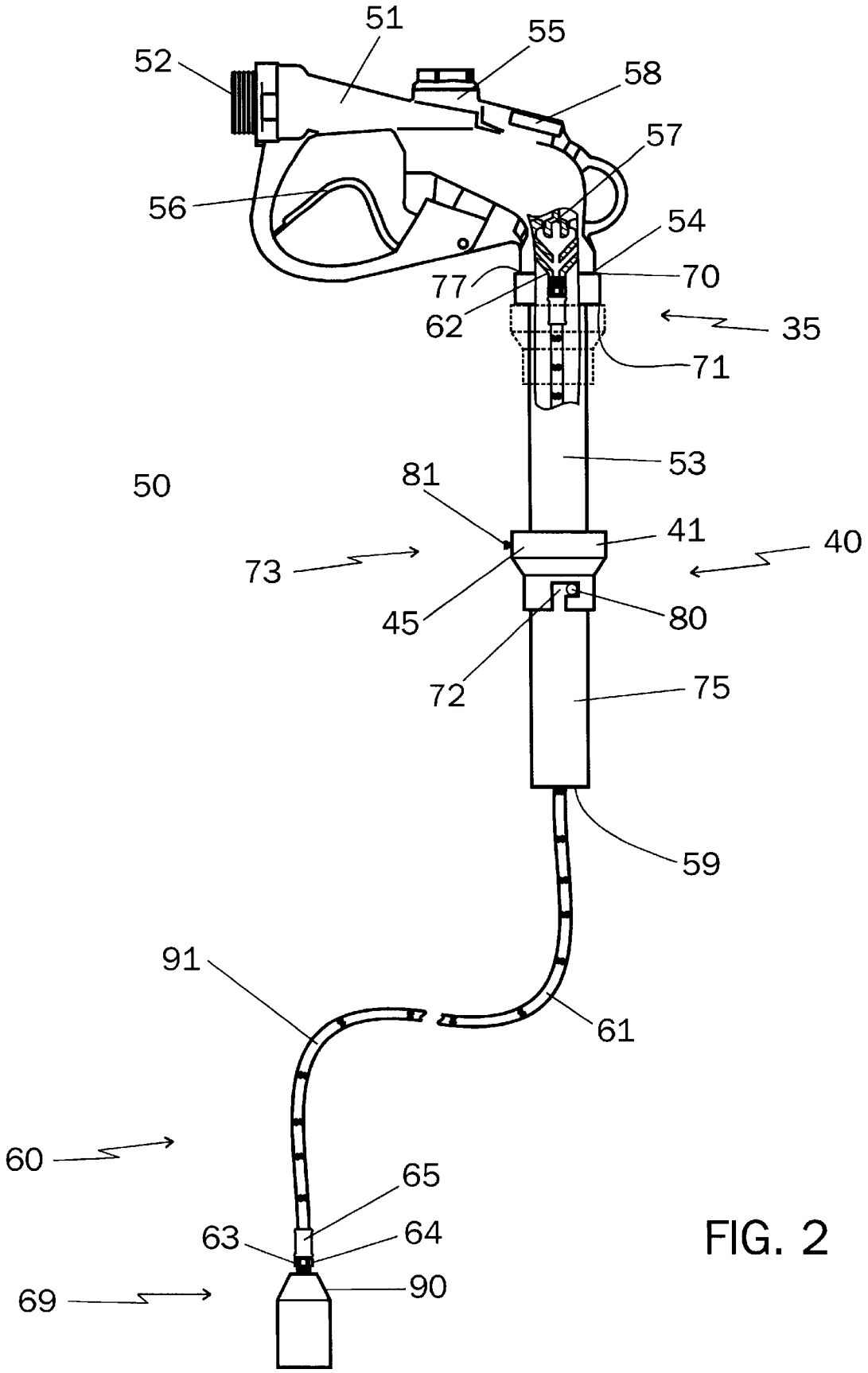
FIG. 2 is an plan view in partial cross section of the preferred embodiment of the fueling nozzle of this invention for use at the fueling station in FIG. 1 showing in full view an adjustable stop collar in a fully extended position and showing in phantom view the adjustable stop collar in a fully retracted position.

Referring now to FIGS. 1 and 2, an automated fueling nozzle 50 adapted for transferring fuel from a fuel storage tank to a vehicle fuel tank 15 is provided wherein vehicle fuel tank 15 has an inlet conduit 20 and a separate venting stand pipe associated therewith. Fueling nozzle 50 comprises a hollow body 51 having an inlet port 52, an outlet spout 53 at one end 54 of body 51, a main valve 55 in body 51 for controlling flow of fuel from inlet port 52 through spout 53, means for manually operating 56 main valve 55, a pressure actuated valve 57 within body 51 adjacent outlet spout 53. Pressure actuated valve 57 has opposed surfaces between a tappet and a seat for providing a Venturi means for creating a vacuum and a release means 58 for automatically releasing the main valve 55 responsive to a vacuum sensing means 60 controlling the vacuum, the details fully described in the aforementioned U.S. Pat. No. 3,085,600. Pressure actuated valve 57 generates vacuum by causing fuel to flow through a restricted port having a vacuum tap in the throat thereof as is fully evident from a reading of the aforementioned U.S. Pat. No. 3,085,600 issued to Arthur Briede, the contents therein fully incorporated into this specification by this reference thereto. Though U.S. Pat. No. 3,085,600 shows and describes one particular pressure actuated valve 57 with a vacuum port 77 associated therewith, other means of generating vacuum for use in sensing a back flow thereby automatically ceasing flow through nozzle 50 may be utilized without departing from the scope of the invention contained in the instant specification.

It has been found by the teachings of this invention that wherein the vacuum sensing means 60 is disposed outboard of a discharge end 59 of outlet spout 53 to prevent reflux of fuel from the vehicle tank 15 through the conduit 20, overfilling and spillage in a high flow rate filling operation has been virtually eliminated by sensing the level of filling prior to back flow through the open end 21 of the filling inlet conduit 20 or through the separate venting stand pipe 25. Automated fueling nozzle 50 further has vacuum sensing means 60 disposed within the fuel stream being discharged from discharge end 59 wherein vacuum sensing means 60 is disposed substantially contiguous with an uppermost fueling level 18 of vehicle tank 15.

Figure 3:
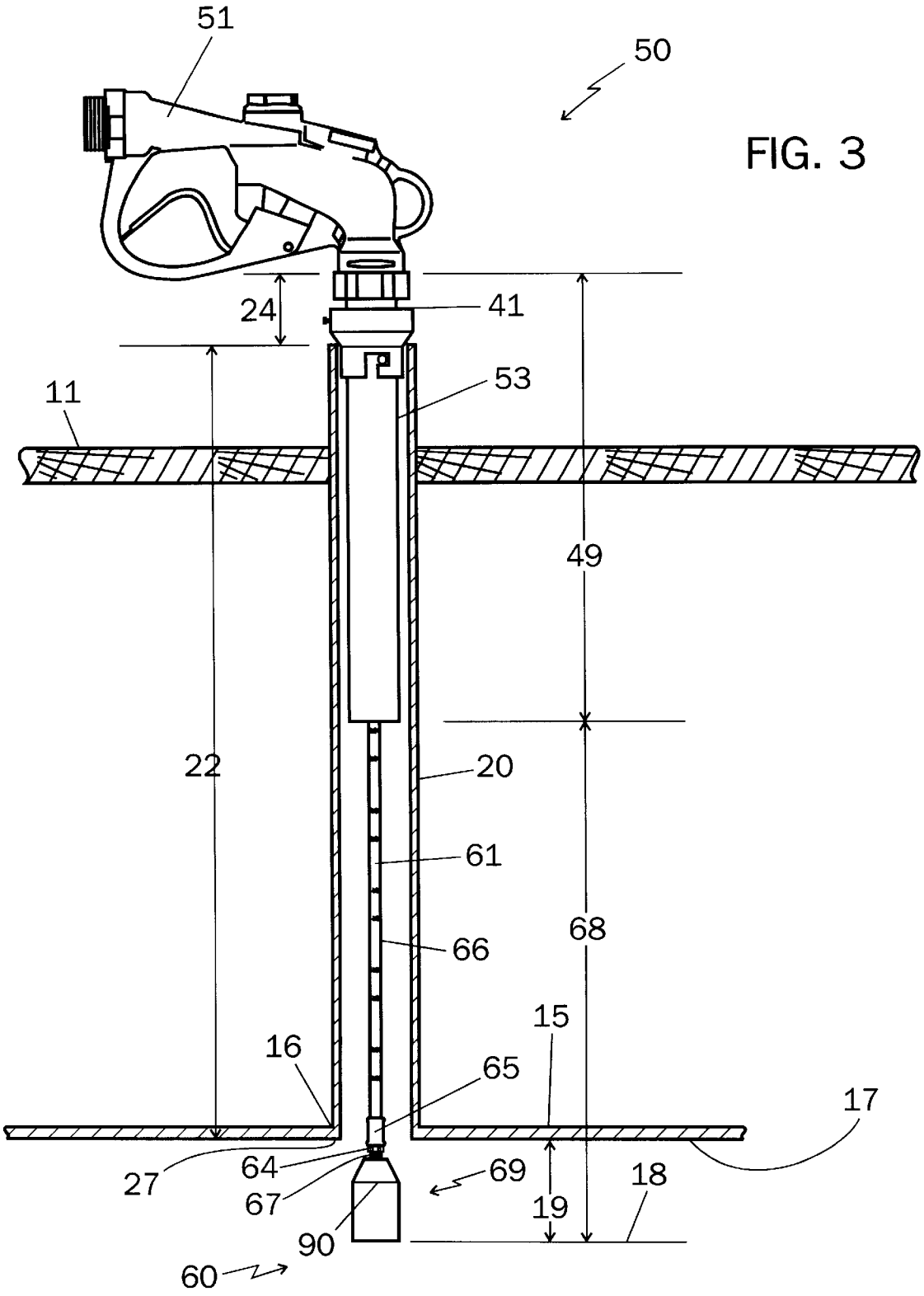
FIG. 3 is a partial section view of the deck, elongated fuel receiving inlet conduit and fuel tank top of the fueling station of FIG. 1 showing the adjustable stop collar on the fueling nozzle of this invention in a fully retracted position in preferred engagement with an elongated fuel receiving inlet conduit.

As is best shown in FIG. 3, automated fueling nozzle 50 has vacuum sensing means 60 disposed at a distance 68 from the discharge end 59 approximately equal to the length 22 of elongated inlet conduit 20 of fuel tank 15 less the length 49 of outlet spout 53 as minimum headspace 19 is approximately the same as the length of nut 74 plus the length of the protruding portion of adjusting ring 45. Minimum headspace 19 is measured from uppermost fueling level 18 to the bottom of tank top 17. Length 49 of outlet spout 53 is measured from discharge end 59 to first end 70, first end 70 being contiguous with and releasably secured to one end 54 of hollow body 51. Typically, length 49 is approximately 14 inches thus allowing sufficient length of outlet spout 53 to be inserted into inlet end 21 of fueling conduit 20 and be removably retained therein without constant operator handling whether outlet spout 53 has means for adjusting 40 at first stop 71, an intermediate stop or at terminal stop 72.

Figure 6:
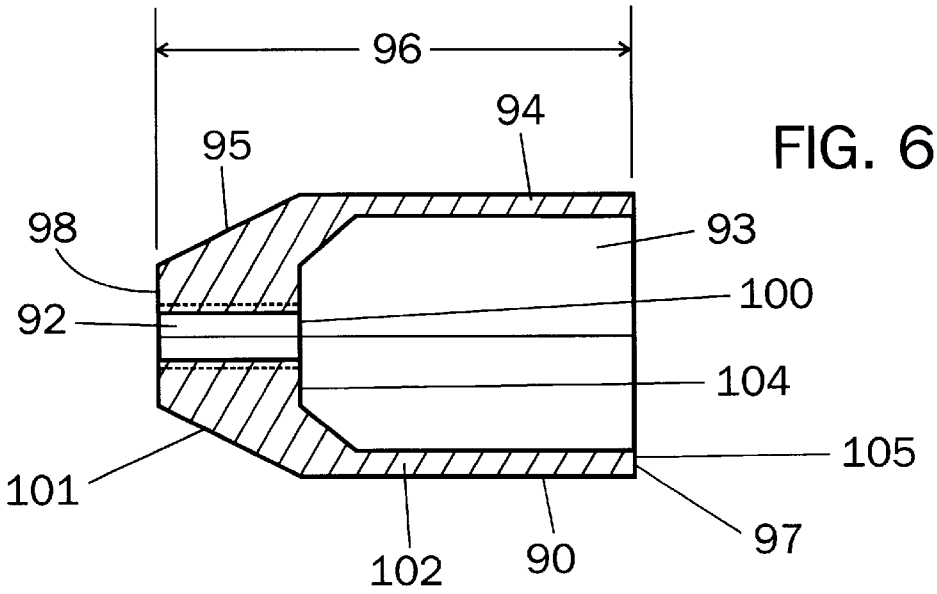
FIG. 6 is an enlarged view of the conical shaped shutoff pickup port of the fuel nozzle of this invention.

Referring now to FIGS. 2 and 6, automated fueling nozzle 50 has vacuum sensing means 60 disposed at an open end 63 of an elongated tube 61, elongated tube 61 depending from hollow body 51 independent of outlet spout 53. Preferably, one end 62 of elongated tube 61 is connected directly to a vacuum port 77 associated with pressure actuated valve 57. Elongated tube 61 is adapted to be inserted into open end 21 of fuel inlet conduit 20 before outlet spout 53 is inserted into open end 21 such that elongated tube 61 extends into vehicle fuel tank 15 below the top 17 of fuel tank 15. Preferably, open end 63 of elongated tube 61 has means for directing 69 the fuel stream being discharged from discharge end 59 of fuel spout 53, means for directing 69 comprising an cylinder 90 affixed to open end 63 of elongated tube 61, cylinder 90 having a conical shaped end 98 adapted for directing the fuel stream away from the vacuum sensing means 60. Though means for directing 69 preferably has cone shaped end 98 on cylinder 90, means for directing 69 could comprise other means including an hemispherical shaped end replacing cone shaped end 98 or could comprise a conical or hemispherical cup mounted on open end 63 of elongated tube 61 without having a cylindrical extension associated therewith. It has been found by the teachings of this invention that cylinder 90 having cone shaped end 98 with vacuum sensing port 100 recessed into recessed cup 93 disposed within cylinder 90 from open end 97 thereof allows for filling of a vehicle tank 15 to uppermost fueling level 18 without spillage of fuel from either venting stand pipe 25 or open end 21 of filling inlet conduit 20. It has been further found by the inventors that elongated tube 61 comprising a flexible tube 91 allows elongated tube 61 to be inserted into a variety of filling inlet conduits 20 including inlet conduits 20 having curved portions 23.

Referring also to FIG. 1, automated fueling nozzle 50 having conical shaped end 98 disposed on one end of cylinder 90 and the smaller base 102 of conical shaped end 98 affixed contiguous with open end 63 of elongated tube 61 disposes vacuum sensing means 60 substantially centrally within the fuel stream as the fuel stream tends to impinge equally on all parts of the smooth surface 101 of conical shaped end 98 and flow evenly therefrom, creating centering forces on smooth surface 101. The open end 97 of cylinder 90 has a cylindrical wall 103 surrounding recessed cup 93, open end 97 substantially disposed remote open end 63 of tube 61 by a length 96. Referring specifically to FIG. 6, cylinder 90 has a tapered section 95 at cone shaped end 98 thereof and a straight section 94 at open end 97, tapered section 95 having smooth outer surface 101 on the outer surface thereof smooth outer surface continuing along cylinder 90 upon the outer surface of a wall 103 of straight section 94. Wall 103 of straight section 94 surrounds recessed cup 93 and hence vacuum sensing port 100, vacuum sensing port 100 disposed through an inner wall 104 of tapered section 95, vacuum sensing port 100 mating with threaded hole 92 disposed through tapered section 95 from conical end 98. Thus, vacuum sensing port 100 communicates with elongated tube 61 through threaded hole 92 and when the fuel level rises in the vehicle tank 15 to uppermost level 18, end surface 105 of open end 97 is contacted by the rising fuel thereby causing a sudden rise in vacuum in recessed cup 93 and elongated tube 61 tripping release means 58 on nozzle 50.

Figure 4:
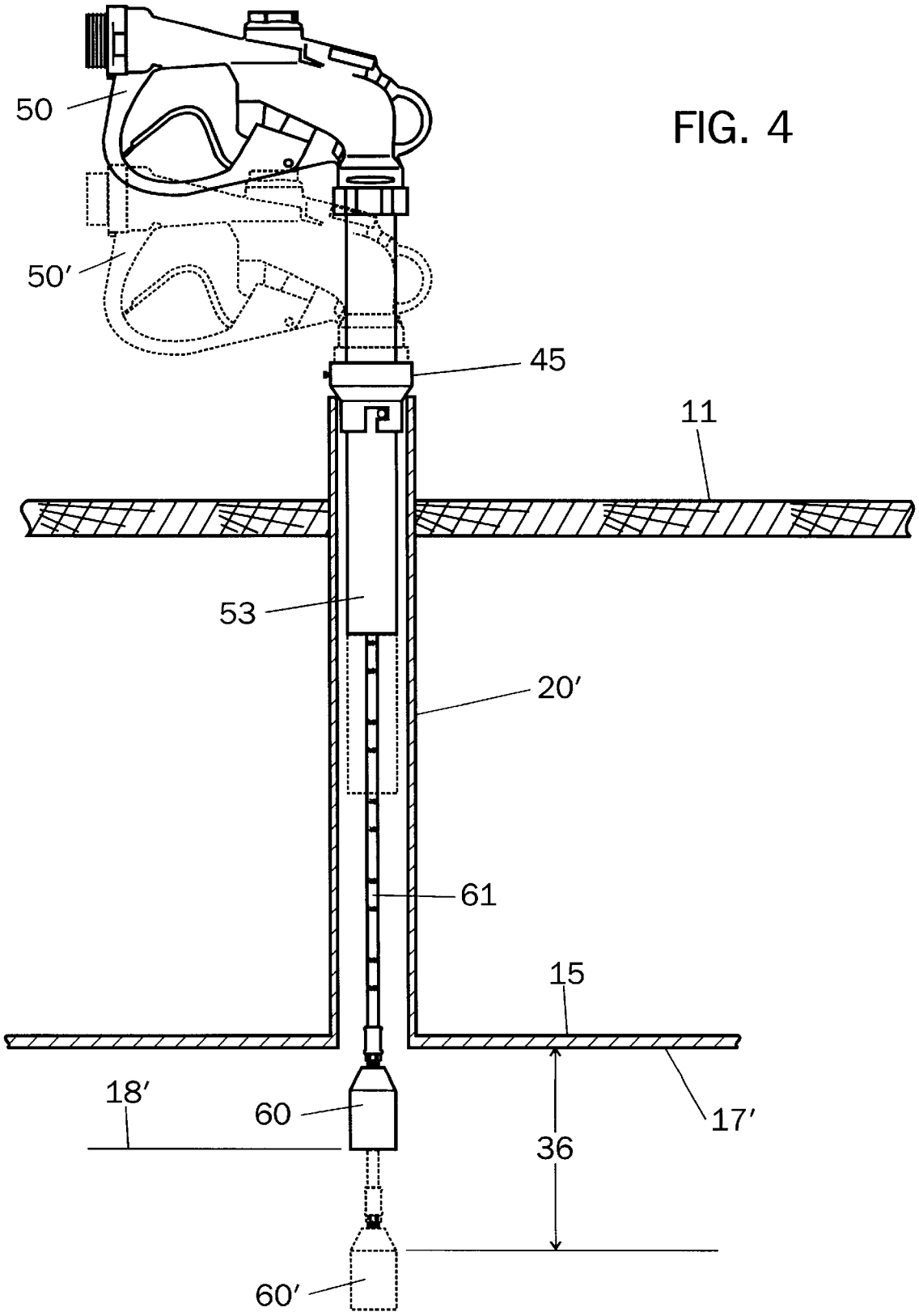
FIG. 4 is partial section view of the deck, a shortened fuel receiving inlet conduit and fuel tank top of the fueling station of FIG. 1 showing in full view the fueling nozzle of this invention with the adjustable stop collar thereon in a fully extended position for use in a shortened fuel receiving inlet conduit and showing in phantom view the fueling nozzle of this invention with the adjustable stop collar thereon in a fully retracted position.

Automated fueling nozzle 50 of this invention is best used for transferring fuel from a fuel storage tank to one of several vehicle fuel storage tanks such as vehicle fuel tank 15 having an inlet conduit 20. However, referring to FIGS. 3 and 4, it is apparent that inlet conduits 20 for the various fuel storage tanks do not always have the same length and therefore, vacuum sensing means 60 may not be disposed at an optimum point substantially adjacent uppermost fueling level 18 of vehicle tank 15. Thus, when fueling nozzle 50 of this invention is used to fuel a vehicle tank 15 having a different length of inlet conduit 20, especially one having a shorter inlet conduit as represented in FIG. 4, there is a need to adjust fueling nozzle 50 to allow vacuum sensing means 60 to be at uppermost fueling level 18. Therefore, fueling nozzle 50 has outlet spout 53 fitted with a means for adjusting 40 the depth of penetration of outlet spout 53 into inlet conduit 20 of vehicle tank 15.

Figure 7:
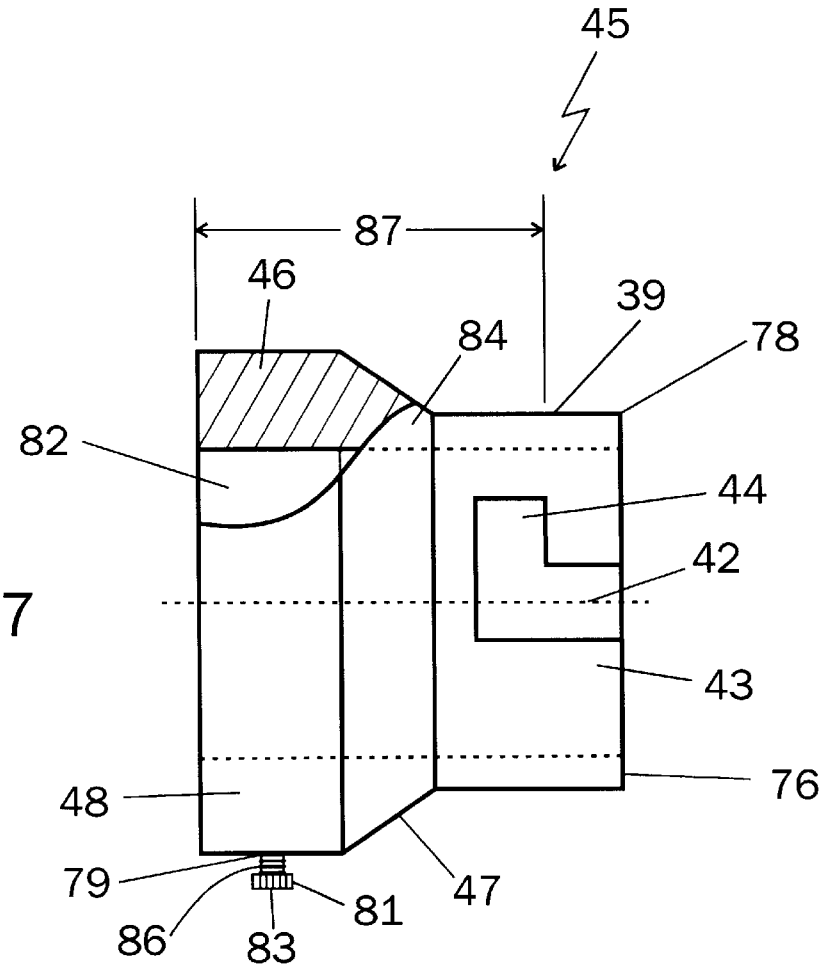
FIG. 7 is an enlarged view of the adjustable stop collar showing the key slot for releasably receiving a stop pin therein.

Referring now to FIGS. 1 and 7, automated fueling nozzle 50 has means for adjusting 40 comprising an annular adjusting ring 45 disposed around outlet spout 53. Means for adjusting 40 may be disposed at any position along outlet spout 53 but in order to keep a portion of outlet spout 53 disposed within inlet conduit 20, a fully extended position 30 of means for adjusting 40 is displaced inwardly from discharge end 59 at stop 72. Also, to accommodate an elongated inlet conduit 20, means for adjusting 40 must be placed in a fully retracted position 35, fully retracted position 35 being contiguous with one end 54 of nozzle 50. In the automated fueling nozzle 50 of this invention, outlet spout 53 has a first end 70 opposite the discharge end 59 affixed to hollow body 51 at one end 54, means for adjusting 40 having a first stop 71 disposed adjacent first end 70. First stop 71 may comprise rear face 82 of annular adjusting ring 45 abutting nut 74, nut 74 holding outlet spout 53 to one 54 of nozzle 50 but may utilize a means for affixing 73, such as thumb screw 81, associated with annular adjusting ring 45 of means for adjusting 40 or preferably utilizes a stop pin, such as stop pin 80 hereinafter described, disposed on outlet spout 53 near nut 74. In the preferred embodiment, first stop 71 comprises rear face 82 of annular adjusting ring 45 abutting nut 74. Terminal stop 72 is generally disposed spaced inwardly from said discharge end but may be disposed substantially at said discharge end.

Referring specifically to FIG. 7, adjusting ring 45 for automated fueling nozzle 50 has an enlarged end 48 and a pilot sleeve 39 separated by an tapered section 84. Enlarged end 48 is greater in diameter than inlet 21 of inlet conduit 20 such that adjusting ring 45 may rest upon inlet 21. Specifically, adjusting ring 45 rests upon inlet 21 on angled surface 47 of tapered section 84 while pilot sleeve 39 is adapted to slide within inlet 21. Pilot sleeve 39 is slightly smaller in diameter than inlet 21 and hence has an easy running fit therein. Pilot sleeve 39 may have a taper or radius at 78 on a terminal end 76 thereof to facilitate placing pilot sleeve 39 into inlet 21. Adjusting ring 45 has a bore 38 through its center, bore 38 slightly larger than an outside diameter of fuel outlet spout 53 such that adjusting ring 45 may be readily moved along the outside surface 75 of outlet spout 53 for movement between first stop 71, any intermediate stop placed upon outlet spout 53 and terminal stop 72. One convenient means to removably secure adjusting ring 45 at an intermediate stop is to provide a thumb screw 81 threaded through a wall 46 of annular adjusting ring 45 wherein wall 46 has a threaded receiving hole 79 bored and threaded therethrough. Thumb screw 81 has a threaded shaft 86 having a length to pass through wall 46 and engage outside surface 75 of fuel outlet spout 53, thumb screw head 83 extending radially outwardly from enlarged end 48 sufficiently to be grasped between the forefingers and thumb of ones hand.

The preferred stops outboard of first stop 71 however, are similar to stop pin 80 disposed at terminal stop 72. Stop pin 80 is typically a short socket head cap screw threaded into a hole at terminal stop 72, the head of the socket head cap screw slightly smaller than a slot 42 disposed in adjusting ring 45 extending inwardly from terminal end 76 of pilot sleeve 39. Slot 42 may extend completely through adjusting ring 45 as shown by phantom lines in FIG. 7 and will have a key portion 44 extending at a right angle to slot 42. Slot 42 and key portion 44 are disposed through the wall 43 of pilot sleeve but do not pass completely through wall 46 of enlarged end 48. Thumb screw 81 may be aligned with slot 42 in wall 46 though it is not necessary to do so. Key portion 44 is approximately the same width as slot 42 and hence will readily capture the head of the socket head cap screw therein when adjusting ring 45 is rotated around outlet spout with the head of the socket head cap screw aligned with key portion 44. Intermediate stops must be at least a distance 87 apart in order to be able to rotate adjusting ring 45 around outlet spout 53.

Vacuum sensing means 60 is constructed of an elongated tube 61 preferably of a flexible woven metallic covered thermoplastic or thermosetting elastomeric tube 91 readily available in the market, couplings for both ends thereof and cylindrical member 90. Each end of elongated tube 61 has a crimped flare coupling 65 crimped upon the end thereof, flare couplings 65 having a threaded end for mating with threaded bores in vacuum port 77 in pressure actuated valve body 57 and threaded hole 92 in cone shaped end 98 of cylinder 90. A swivel coupling 64 may be affixed between open end 63 of elongated tube 61 and cylinder 90 such that cylinder 90 may freely rotate thereon. Cylinder 90 is formed from a solid cylindrical bar of thermoplastic material, preferably of Delrin, a registered trademark of the E. I. DuPont Co. Cylinder 90 is machined smooth on outer surface 101 preparing a tapered section 95 simultaneously. Recessed cup 93 is centrally bored into cylinder 90 from open end 97 extending through to inner wall 104. A hole is then bored and threaded through conical end 98 from inner wall 104 creating vacuum port 100 and threaded hole 92. Cylinder 90 is then cut off the bar of stock at a length 96 as measured from open end 97 to conical end 98. Cylinder 90 may be affixed to elongated tube 61 prior to assembly onto nozzle 50 or may be affixed to open end 63 after one end 62 is threaded into vacuum port 77 in nozzle 50.

Adjusting ring 45 is likewise formed from a solid cylindrical bar of thermoplastic material, preferably of Delrin, a registered trademark of the E. I. DuPont Co. The cylindrical bar is approximately the same diameter as enlarged end 48. Pilot sleeve 39 is formed upon the solid bar by machining away excess material followed by forming tapered section 84 in a similar manner. Bore 38 is formed through adjusting ring 45 by boring through the solid bar from terminal end 76 to beyond rear face 82. Slot 42 is formed into wall 43 of pilot sleeve 39 and through bore 38 utilizing a milling cutter. Key portion is similarly fashioned at one edge of slot 42. Receiving hole 79 is drilled through wall 46 of enlarged end 48 transverse the longitudinal axis of adjusting ring 45 and threaded for receiving thumb screw 81. Adjusting ring 45 is then divided from the elongated bar of material at rear face 82. Thumb screw 81 may then be inserted into receiving hole 79.

In a method of making the fueling nozzle 50 of this invention, a fueling nozzle like the automatic fueling nozzles described in the aforementioned U.S. Pat. No. 3,085,600 is modified by removing the outlet spout and the venting tube, #35 and #47, respectively, in the patent, and replacing same with fueling spout 53 and venting tube 61 of this invention. After removal of these two parts from the nozzle, elongated tube 61 is threaded into vacuum port 77 in this nozzle 50 and thereafter first end 70 of fueling spout 53 is slipped over elongated tube 61. Fueling spout 53 is then coupled to one end 54 of hollow body 51 of fuel nozzle 50 and secured thereto with nut 74. Adjusting ring 45 is then slipped elongated tube 61 and subsequently over discharge end 59 of fuel spout 53 sliding bore 38 upon outer surface 75 of fuel spout 53 until rear face 82 engages stop pin 80 at terminal stop 72. Adjusting ring 45 is then rotated until slot 42 aligns with stop pin 80 whereby adjusting ring 45 may be further slipped upon outer surface 75 of outlet spout 53 until key 44 aligns with stop pin 80 or until rear face 82 abuts nut 74. Adjusting ring 45 may be locked onto stop pin 80 by rotating adjusting ring 45 until key portion 44 captures stop pin 80 therein or adjusting collar 45 may alternately be secured to outer surface 75 at any point therealong by securing thumb screw 81 against outer surface 75.

Referring now to FIGS. 1 through 3, automated fueling nozzle 50 is used for transferring fuel from a fuel storage tank to a vehicle fuel tank 15, vehicle fuel tank 15 having an inlet conduit 20 associated therewith. Prior to beginning the fueling operation, fueling spout 50 of FIG. 2 is moved adjacent inlet 21 of inlet conduit 20 and cylinder 90 of vacuum sensing means 60 is inserted into inlet 21. Elongated tube 61 snakes through inlet conduit 20 as discharge end 59 of outlet spout 53 at one end 54 of nozzle 50 is incrementally moved toward inlet 21. Discharge end 59 is then inserted into inlet 21 and lowered into inlet conduit 20 with adjusting ring 45 coming to rest upon the mouth of inlet 21. If the total length 22 of inlet conduit 20 is known, adjusting ring 45 may be placed upon the appropriate stop pin and rotated to lock the head of the stop pin into key 44 and the fueling operation may begin by opening main valve 55 in body 51 beginning the flow of fuel from inlet port 52 to spout 53 and hence into tank 15 through inlet conduit 20. Flexible tube 91 will generally slide through inlet conduit 20 and extend into fuel tank 15 as flexible tube 91 resists compressive forces shortening flexible tube 91, however, in the event flexible tube 91 would fail to move the entire length of inlet conduit 20, the force of fuel impinging upon tapered section of cylinder 90 at the beginning of the fueling operation would extend flexible tube 91 into the headspace in tank 15. As is represented in FIG. 3, inlet conduit 20 extends from above deck plate 11 to fuel tank 15 where inlet conduit 20 is affixed thereto at connection 16. With adjusting ring 45 abutting nut 74 on end 54 of nozzle 50, vacuum sensing means extends into tank 15 below top 17 to an approximate uppermost fueling level 18. The length 22 of inlet conduit 20 is approximately equal to distance 68 from the discharge end 59 plus the length 49 of outlet spout 53 as headspace 19 is approximately the same as the length of nut 74 plus the length of the protruding portion of adjusting ring 45. It is also apparent that vacuum sensing means 60 is disposed at a distance from one end 54 of body 51 at least equal to the length 22 of inlet conduit 20 of fuel tank 15. As is readily apparent from viewing of FIG. 3, vacuum sensing means 60 is disposed below the bottom of tank top 17 and therefore clear of the end 27 of fuel inlet conduit 20. As the fueling operation commences, fuel flows from discharge end 59 of outlet spout 53 through inlet conduit 20 around elongated tube 61 and flows out of end 27 of fuel inlet conduit 20. During the fueling operation, a vacuum is created in recessed cup 93 by the venturi action of pressure actuated valve 57 acting through vacuum port 77, through elongated tube 61, through vacuum sensing port 100 and into recessed cup 93 causing release means 58 to remain in a fuel dispensing position as is well known in the art. Tapered section 95 of cylinder 90 causes the fuel exiting from end 27 to flow evenly around vacuum sensing means 60 until tank 15 approaches uppermost fuel level 18. When fuel rises to uppermost fueling level 18 the surface of the fuel closes off open end 97 of cylinder 90 causing a sudden change in vacuum. Vacuum actuated release means 58 responds to sudden change of vacuum by releasing the trip lever closing the main valve 55 in nozzle 50. As the fuel level has not risen above uppermost fueling level 18 in tank 15, the vacuum sensing means 60 of this invention prevents reflux of fuel from the vehicle tank 15 through the conduit 20.

Referring now to FIGS. 1, 2 and 4, a shorter fuel inlet conduit 20' is shown with the fuel nozzle 50 of this invention extending through inlet conduit 20 and into fuel tank 15. The phantom lines represent fuel nozzle 50' fully inserted into fuel tank 15 with vacuum sensing means disposed below top 17' of tank 15 by a distance 36. Distance 36 may be any amount, but it has been found by the teachings of this invention that most fuel inlet conduits on marine vessels differ very little. A fueling operation may be completed with vacuum sensing means disposed below uppermost fueling level 18' however, the tank would not be filled to a maximum level. In order to properly fill fuel tank 15 to an optimum level such as uppermost fueling level 18', it is necessary to adjust the distance vacuum sensing means 60 is disposed into the headspace of fuel tank 15. This may be readily accomplished by retracting nozzle 50 from inlet conduit 20 by approximately distance 36. As it would be difficult for the fueling operator to manually hold the nozzle 50 of this invention above inlet 21 by distance 36, it has been found by the teachings of this invention that nozzle 50 may be supported on the mouth of inlet 21 by providing a means for adjusting 40 associated with outlet spout 53. Since distance 36 is generally known to the fueling operator, adjustable ring 45 of means for adjusting 40 may be moved along outlet spout 53 towards discharge end 79 and releasably locked onto outlet spout 53 by stop pin 80 of means for adjusting 40 or by thumb screw 81 of means for adjusting 40. Where stop pin 80 is utilized, stop pin 80 is moved into engagement with key portion 44 of slot 42 by rotating adjusting ring 45 such that stop pin 80 engages key portion 44. Where thumb screw 81 is utilized, adjusting ring 45 is locked onto outlet spout 53 by tightening threaded shaft 86 of thumb screw 81 against outside surface 75 of outlet spout 53. Nozzle 50, as shown in full view, may then be lowered into engagement with inlet 21 having angled surface 47 of adjusting ring 45 rest upon inlet 21 and the fueling operation completed as recited above.

Figure 5:
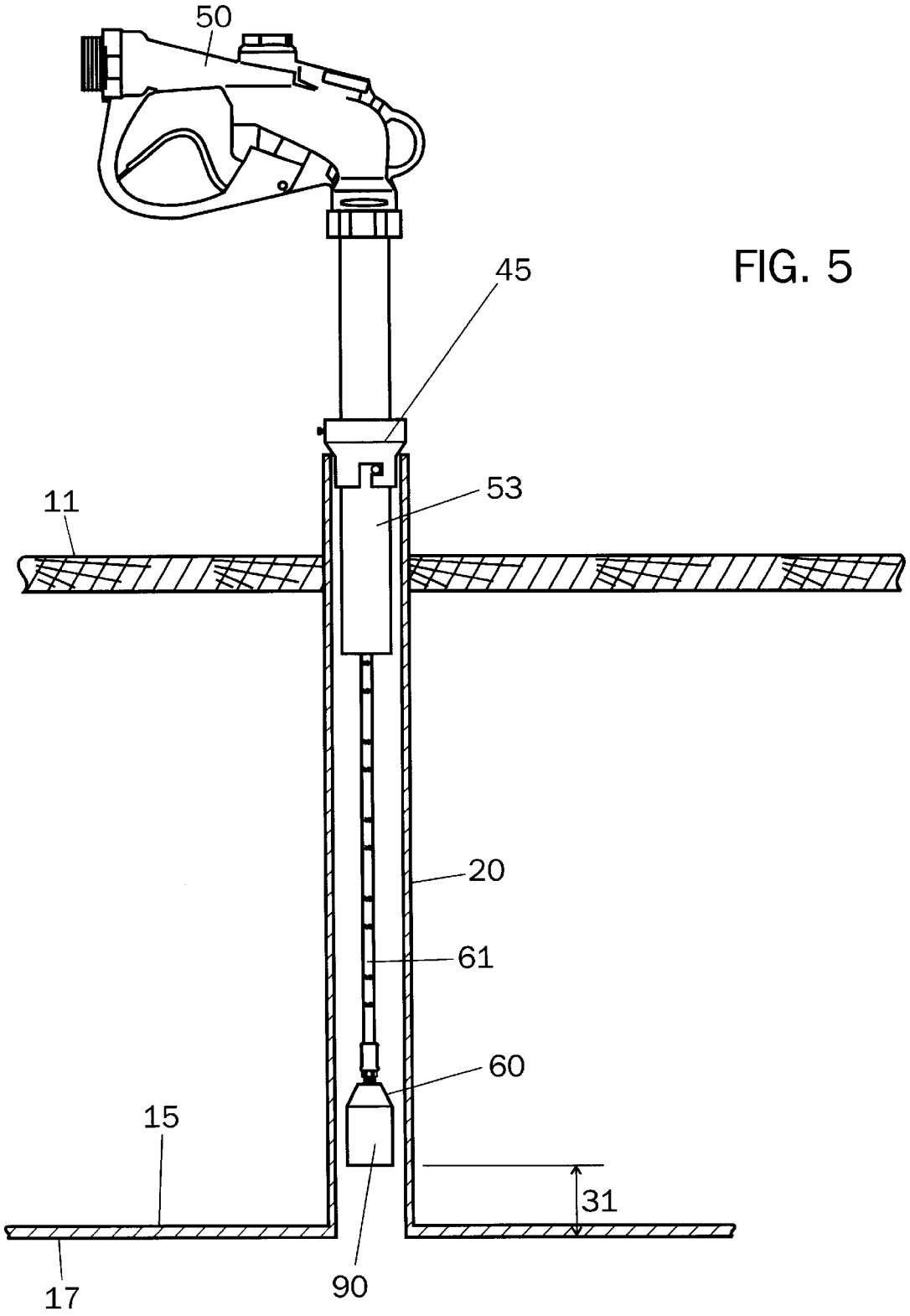
FIG. 5 is partial section view of the deck, an elongated fuel receiving inlet conduit and fuel tank top of the fueling station of FIG. 1 showing the adjustable stop collar on the fueling nozzle of this invention in a fully extended position in the elongated fuel receiving inlet conduit.

In case nozzle 50, as shown in FIG. 4, having adjustable ring 45 in an extended position such as at stop pin 80 is removed from shorter inlet conduit 20' and inserted into a lengthened conduit 20 as is shown in FIG. 5, vacuum sensing means 60 will have cylinder 90 disposed within fuel conduit 20 but not yet fully extended into fuel tank 15. If a fueling operation is begun with nozzle 50 in the position shown in FIG. 5, the operation will be immediately terminated as fuel passing between cylinder 90 and fuel inlet conduit 20 will swirl upwardly into recessed cup 93 interrupting the vacuum being generated to set release means 58 thereby tripping release means 58. In this instance, the fueling operator will immediately recognize that adjusting means 40 must be readjusted to lower vacuum sensing means 60 into tank 15 to provide for a proper fueling operation. The quick release nature of means for adjusting 40 allows rapid repositioning of nozzle 50 making for an efficient fueling operation. Adjusting ring 45 of means for adjusting 40 is then released from the position shown in FIG. 4 by unseating thumb screw 81 or rotating adjusting ring 45 such that stop pin 80 aligns with slot 42. Adjusting ring 45 may then be moved along fuel outlet spout 53 to a new position and secured thereto in the manner described above to provide for fueling of the tank 15. Of course, if conduit 20 is greatly extended and cylinder 90 still is not positioned within the headspace in the fueling tank, nozzle 50 may be withdrawn, fueling spout 53 removed and vacuum sensing means 60 replaced with another vacuum sensing means 60 having an elongated tube 61 of greater length. Fueling spout 53 may then be reattached to nozzle body 51 with nut 74 and the fueling operation again attempted. Fueling spout 53 may also be replaced with a longer fueling spout 53 when utilizing vacuum sensing means 60 having elongated tube 61 of greater length. It is readily apparent from a reading of the specification above that damage to the environment and loss of fisheries from fuel being washed from the decks of marine vessels may be wholly eliminated by utilizing the nozzle 50 of this invention having vacuum sensing means disposed outboard of a discharge end 59 of a fueling spout 53 and into the head space of a fuel tank 15.

While the present invention has been described with reference to the above described preferred embodiments and alternate embodiments for use in marine vessels, it should be noted that various other embodiments and modifications may be made and the improved nozzle utilized for other filling services without departing from the spirit of the invention. Therefore, the embodiments described herein and the drawings appended hereto are merely illustrative of the features of the invention and should not be construed to be the only variants thereof nor limited thereto.

We claim:

1. In an automated fueling nozzle adapted for transferring fuel from a fuel storage tank to a vehicle fuel storage tank, said vehicle fuel tank having an inlet conduit associated therewith, said fueling nozzle comprising a hollow body having an inlet port, an outlet spout at one end of said body, a main valve in said body for controlling flow of fuel from said inlet port to said spout, means for manually operating said main valve, a pressure actuated valve within said body adjacent said outlet sport, said pressure actuated valve having opposed surfaces between a tappet and a seat for providing a Venturi means for creating a vacuum and a release means for automatically releasing said main valve responsive to a vacuum sensing means controlling said vacuum, the improvement wherein said vacuum sensing means carried by said nozzle is disposed outboard of a discharge end of said outlet spout.

2. An automated fueling nozzle as described in claim 1 wherein said vacuum sensing means is disposed within the fuel stream being discharged from said discharge end.

3. An automated fueling nozzle as described in claim 1 wherein said vacuum sensing means is disposed substantially contiguous with an uppermost fueling level of said vehicle storage tank.

4. An automated fueling nozzle as described in claim 1 wherein said vacuum sensing means is disposed at a distance from said discharge end at least equal to the length of said inlet conduit of said fuel tank and less the length of said outlet spout.

5. An automated fueling nozzle as described in claim 4 wherein said vacuum sensing means is disposed at an open end of an elongated tube, said elongated tube depending from said hollow body wherein said elongated tube is independent of said outlet spout.

6. An automated fueling nozzle as described in claim 5 wherein said end of said elongated tube has means for directing said fuel stream.

7. An automated fueling nozzle as described in claim 6 wherein means for directing said fuel stream comprises a cone shaped member affixed to said end of said elongated tube, said cone shaped member directing said fuel stream away from said vacuum sensing means.

8. An automated fueling nozzle as described in claim 7 wherein said cone shaped member has the smaller base thereof affixed contiguous with said end of said elongated tube.

9. An automated fueling nozzle as described in claim 7 wherein said cone shaped member has said smaller base thereof affixed to said end of said elongated tube wherein the larger base of said cone shaped member is substantially disposed remote said end of said elongated tube.

10. An automated fueling nozzle as described in claim 5 wherein said elongated conduit comprises a flexible tube.

11. An automated fueling nozzle as described in claim 10 wherein said cone shaped member disposes said vacuum sensing means substantially centrally within said fuel stream.

12. In an automated fueling nozzle adapted for transferring fuel from a fuel storage tank to a vehicle fuel storage tank, said vehicle fuel tank having an inlet conduit associated therewith, said fueling nozzle comprising a hollow body having an inlet port, an outlet spout at one end of said body, a main valve in said body for controlling flow of fuel from said inlet port to said spout, means for manually operating said main valve, a pressure actuated valve within said body adjacent said outlet sport, said pressure actuated valve having opposed surfaces between a tappet and a seat for providing a Venturi means for creating a vacuum and a release means for automatically releasing said main valve responsive to a vacuum sensing means controlling said vacuum, the improvement wherein said outlet spout has means for adjusting the depth of penetration of said outlet spout into said inlet conduit of said vehicle tank.

13. An automated fueling nozzle as described in claim 12 wherein said means for adjusting comprises an annular adjusting ring disposed around said outlet spout.

14. An automated fueling nozzle as described in claim 13 wherein said annular adjusting ring has means for affixing for releasably affixing said annular adjusting ring to said outlet spout.

15. An automated fueling nozzle as described in claim 14 wherein said means for affixing comprises a thumb screw threaded through a wall of said annular adjusting ring.

16. An automated fueling nozzle as described in claim 12 wherein said outlet spout has a first end opposite said discharge end affixed to said hollow body, said means for adjusting having a first stop disposed adjacent said first end.

17. An automated fueling nozzle as described in claim 16 wherein said means for adjusting further comprising a second stop spaced inwardly from said discharge end.

18. An automated fueling nozzle as described in claim 16 wherein said second stop is disposed substantially at said discharge end.

19. An automated fueling nozzle as described in claim 12 wherein said outlet spout has vacuum sensing means disposed outboard of a discharge end thereof.

20. In an automated fueling nozzle adapted for transferring fuel from a fuel storage tank to a vehicle fuel storage tank, said vehicle fuel tank having an inlet conduit associated therewith, said fueling nozzle comprising a hollow body having an inlet port, an outlet spout at one end of said body, a main valve in said body for controlling flow of fuel from said inlet port to said spout, means for manually operating said main valve, a pressure actuated valve within said body adjacent said outlet sport, said pressure actuated valve having opposed surfaces between a tappet and a seat for providing a Venturi means for creating a vacuum and a release means for automatically releasing said main valve responsive to a vacuum sensing means controlling said vacuum, the improvement wherein said vacuum sensing means carried by said nozzle is disposed outboard of a discharge end of said outlet spout to prevent reflux of fuel from said vehicle tank through said conduit.

* * * * *